United States Patent [19]

Salzberg

[11] 3,931,599

[45] Jan. 6, 1976

[54] HYBRID PHASE INVERTER

[76] Inventor: Edward Salzberg, 19 Black Oak Road, Wayland, Mass. 01778

[22] Filed: Jan. 30, 1975

[21] Appl. No.: 545,525

[52] U.S. Cl. ..... 333/31 R; 333/7 D; 333/11

[51] Int. Cl.[2] ..... H01P 1/18

[58] Field of Search..... 333/7 R, 7 D, 10, 11, 31 R, 333/31 A

[56] References Cited

UNITED STATES PATENTS

| | | | |
|---|---|---|---|
| 3,423,699 | 1/1969 | Hines | 333/31 R |
| 3,559,108 | 1/1971 | Seidel | 333/7 D |
| 3,571,765 | 3/1971 | Friedman | 333/31 R |

*Primary Examiner*—Paul L. Gensler
*Attorney, Agent, or Firm*—Thomas N. Tarrant

[57] ABSTRACT

A microwave hybrid junction with two of the four terminal pairs terminated with matched switchable impedances driven by interconnected circuitry such that if one of the impedances is in its high impedance state, the other is always in its low impedance state and vice versa, providing high energy transfer over a wide band with selectable phase inversion of the output. In combination with other hybrid junctions, a wide and flexible variety of input and output conditions can be obtained by switching the switchable impedances.

9 Claims, 3 Drawing Figures

HYBRID PHASE INVERTER

BACKGROUND OF THE INVENTION

1. Field of the Invention

The invention relates to circuit arrangements of hybrid junction devices.

2. Description of the Prior Art

While there are many radio frequency systems that operate at a single frequency, most operate on a band of frequencies or even a number of bands. The value of a given component is thus often greatly increased when it can be used over an extended range of frequencies.

Off-on rf switching and phase-shifting devices show increasing frequency sensitivity particularly above 300 megahertz. H. Seidel in U.S. Pat. No. 3,559,108 discusses the problem to some extent. As described by Seidel, a four-port hybrid junction in which two ports are connected as input and output terminals and the remaining two ports are terminated with diode switches, is much less affected by phase discrepancies at the switched terminals. For his purposes, Seidel discloses operating the two switches in opposite conductivity for one condition and in equal conductivity for the other condition.

If the quadrature junction circuit of Seidel were to be used as a phase inverter, then the diodes would have to have symmetrical conductivity for both phases, opposite conductivity being an "open switch" condition. The term "phase inverter" as used herein is defined to mean a device which can selectably change the phase of its output signal between two phases 180° apart and implies no specific relation to the phase of the input signal.

Presently available diodes exhibit a reactance change with change in conductivity. This reactance change shows up as frequency sensitivity in conventional diode-switched junctions introducing phase-shift error and reducing switching efficiency away from the design center frequency.

Even in selected diodes, turn-on and turn-off will vary from the optimum differently with frequency change. Thus, though a system can be corrected for any given frequency, wide band operation is difficult to achieve.

SUMMARY OF THE INVENTION

In accordance with the invention, a hybrid-T junction is provided as a broad band 180° phase inverter. With matched diode switches across the two main arm ports and a generator in the shunt H-arm port, asymmetrical switching at the main arm ports produces 180° phase shifts in output at the E-arm port. In this configuration, the reversal in states of the two diode switches always produces a 180° phase shift at the output. Phase errors due to imperfect switching on departure from the design frequency will cause a change in the phase of the reflections in the main arms, but since the switch always produces the same change in reversal for both switch conditions, the output phase shift remains constant. Deterioration shows up eventually only as losses due to increased VSWR. The accurate 180° phase inverter thus provided readily combines into a multitude of circuits for phase shifting, on-off switching, switched directional coupling, modulating, attenuating and the like. The input and output of the hybrid-T can be reversed and various other hybrid junction configurations suited to the reversible asymmetric diode switching can be utilized.

Thus it is an object of the invention to provide a novel 180° phase inverter in the form of a diode-switched hybrid junction.

It is a further object of the invention to provide hybrid junction switching circuits using reversible asymmetrical diode switching.

Further objects and features of the invention will become apparent upon reading the following description together with the Drawing.

DESCRIPTION OF THE PREFERRED EMBODIMENTS

While the inventive concept relates to various types of hybrid couplers in waveguide, coaxial line, microstrip and stripline, the following description is in terms of four-port waveguide hybrids. The description is readily visualized in terms of two types of hybrid couplers. One is the H-plane phase quadrature hybrid symbolized by two lines connected by an encircled H. The other is the hybrid-T symbolized by a block containing the letters HYB-T and having four connecting terminals. The hybrid-T is suitably an H-plane Tee having a series E arm and a shunt H arm indicated by letters E and H on the respective terminals.

Figure 1:
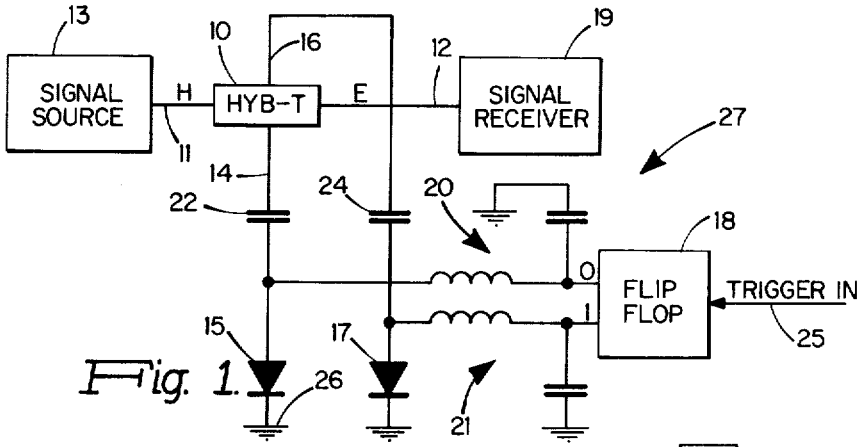
FIG. 1 is a schematic diagram of a hybrid-T phase switch according to the invention.

FIG. 1 depicts hybrid-T 10 connected as a phase inverter. H arm 11 is shown as the input and E arm 12 as the output. Port 14 is shunted by PIN diode 15 and port 16 is shunted by PIN diode 17. Diodes 15 and 17 are biased by complementary outputs 0 and 1 of flip-flop 18. The 0 output is connected through rf filter 20 to the anode of diode 15 and the 1 output is connected through rf filter 21 to the anode of diode 17. The anodes of diodes 15 and 17 are dc isolated from hybrid 10 by capacitors 22 and 24 respectively. Ground reference connection 26 for the cathodes of diodes 15 and 17 and for filters 20 and 21 are depicted by common reference symbols. Flip-flop 18 provides a positive voltage at one output terminal and a zero or reference voltage at the other terminal. At each trigger input at terminal 25, the output voltages reverse in complementary fashion. The entire switching circuit, including diodes, filters and flip-flop, connected to arms 14 and 16 is designated by the numeral 27. The trigger-in may be applied by a simple mechanical switch or any suitable trigger source. Likewise, flip-flop 18 is only exemplary and may be a mechanical reversing switch connected to a suitable voltage source.

Operation of hybrid-T 10 with all arms terminated with the characteristic impedance and the generator in H arm 11 would divide the input signal evenly and in phase between arms 14 and 16 with no coupling to E arm 12. With diodes 15 and 17 connected as terminations of arms 14 and 16, one diode conducting and one nonconducting, the signals in arms 14 and 16 are reflected in antiphase thus adding at E arm 12. When flip-flop 18 is then switched so that the states of diodes 15 and 17 are reversed, the signals in arms 14 and 16 are still reflected in antiphase, but the phase relationships are reversed so that they add at E arm 12 with a 180° phase reversal. Thus each trigger to flip-flop 18 produces a 180° phase shift in the energy at E arm 12. It follows, of course, that if flip-flop 18 is deenergized, both diodes will become nonconducting and the reflections at arms 14 and 16 will be in phase and will cancel at E arm 12.

To the extent there is imperfect switching of diodes 15 and 17, an error angle will occur. However, only antiphase signals reflected from arms 14 and 16 will add at the output while other signals are reflected back to the input. With diodes 15 and 17 matched, reversing their states at a given frequency will yield the same imperfections on switching in reverse. Thus the antiphase signals reflected from the two arms will add to the same result with a 180° phase shift. The phase relation to the input signal will change due to error angle from switching, but any energy that would have produced a change from perfect 180° inversions of the output is reflected back to the input.

It should be noted that, although diodes 15 and 17 are poled alike, one can be reversed. With one of the diodes reversed, the switching voltage applied to both diodes would be the same since it would reverse one and forward bias the other. To effect this, flip-flop 18 would be replaced by a switch with a common pole connected to both filters 20 and 21 and switchable to either a positive or negative voltage source connection.

FIG. 1 thus depicts a broad band phase inverter which will transmit energy in either of two 180° displaced phases and can also be turned off. The two "on" conditions having substantially equivalent broad band frequency characteristics.

Figure 2:
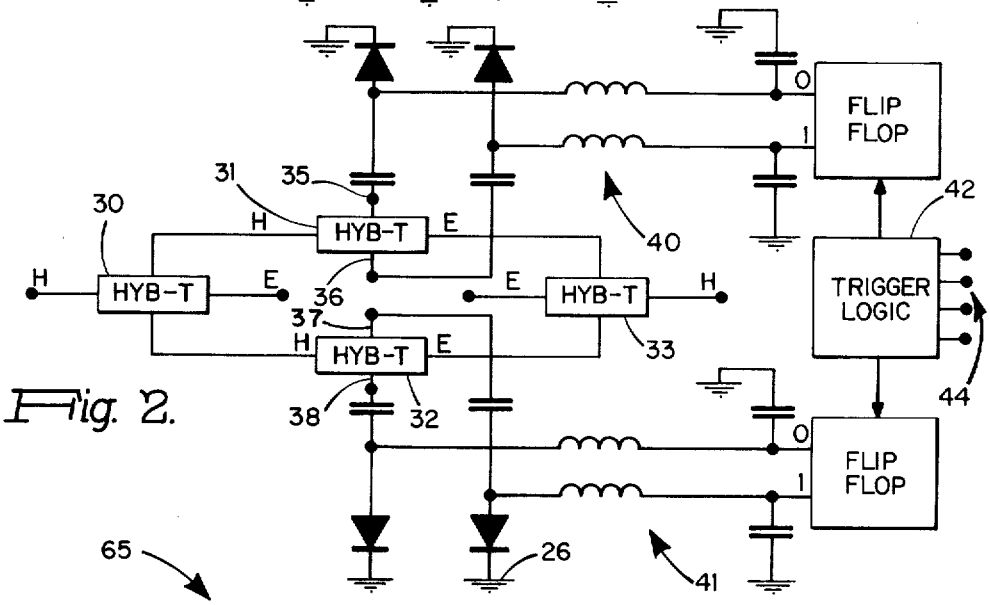
FIG. 2 is a schematic diagram of a four-T hybrid junction switching circuit using the phase switch of FIG. 1.
Figure 3:
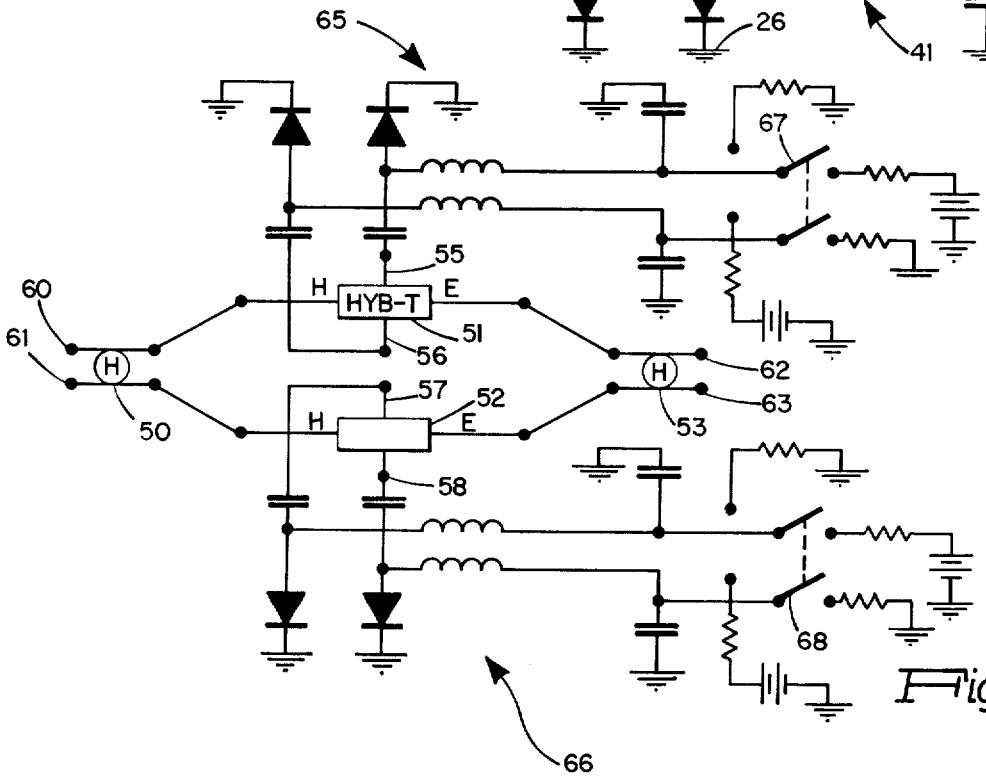
FIG. 3 is a schematic diagram of a second embodiment of a hybrid junction switching circuit using the phase switches of FIG. 1.

FIGS. 2 and 3 depict circuits using four hybrid junctions. They can accept a signal at any one of four terminals and transmit it to a selected output terminal in either of two 180° displaced phase relationships. The terminal choices and phase can be changed as fast as the switching diodes can switch. PIN or similar multilayer diodes having high speed triggering characteristics are commonly used.

FIG. 2 uses four hybrid Tees, 30, 31, 32 and 33. Hybrid Tees 30 and 33 are connected as input/output couplers while Tees 31 and 32 are connected as phase inverters in the manner of FIG. 1.

In FIG. 2 the E and H, series and shunt arms of Tees 30 and 33 are connected as the four input/output terminals. For most purposes unused ones of these four terminals are terminated with their characteristic impedance. The main arms of Tee 30 are connected to the H, shunt arms of Tees 31 and 32 respectively. The main arms of Tee 33 are connected to the E, series arms of Tees 31 and 32 respectively. The main arms ports of Tees 31 and 32 are numbered 35, 36, 37 and 38.

Switching circuit 40, identical to circuit 27 of FIG. 1 is connected to ports 35 and 36 of Tee 31. Similarly switching circuit 41 identical to circuit 27 is connected to ports 37 and 38 of Tee 31. Switching control for the circuit of FIG. 2 is trigger logic 42 which provides the appropriate trigger sequences to the trigger inputs of circuits 40 and 41 in response to signals on its control input terminals 44.

Following is a truth table for FIG. 2:

TRUTH TABLE FOR FIG. 2

| PORTS: Condition | 35 | 36 | 37 | 38 | IN/OUT Path | OUTPUT PHASE DIFFERENCE |
|---|---|---|---|---|---|---|
| I | N | C | N | C | 30 H to 33 H | 180° |
| II | C | N | C | N | 30 H to 33 H | |
| III | C | N | N | C | 30 H to 33 E | |
| IV | N | C | C | N | 30 H to 33 E | 180° |
| V | N | N | N | N | 30 H to 30 H | |

In the above table, the letters N and C indicate that the diodes connected across the indicated ports are Nonconducting (N) or Conducting (C). The IN/OUT path designations are the item numbers of the couplers together with H for the H shunt arm and E for the E series arm. The phase angles are given only relative to each other for the bracketed pairs and not referenced to the input phase angle or to other pairs.

Condition V in the table is with no power to circuits 40 and 41 so that all diodes are nonconducting and all energy is reflected back to the input. Interestingly, if the diodes at ports 35 and 36 are placed in the same conductivity state while the diodes at ports 37 and 38 are both in the opposite conductivity state, operation is still excellent with the output at 30 E. This is because the reactances presented to the main arm ports of Tee 30 are asymmetrical but perfectly reversible in accordance with the invention.

In FIG. 3 the input/output junctions are two phase quadrature hybrid junctions 50 and 53. The diode-switched junctions are two hybrid-Ts 51 and 52. The switched ports of hybrid-Ts 51 and 52 are main arm ports 55, 56, 57 and 58 as in FIG. 2. Input/output ports of junction 50 are 60 and 61 while input/output ports of junction 53 are 62 and 63. The remaining two ports of junction 50 are each connected to the shunt H-arm port of a respective one of junctions 51 and 52. The series E-arm ports of junctions 51 and 52 are connected each to one of the remaining ports of junction 53.

Diode switching circuits 65 and 66 are essentially identical to that of FIG. 1 except that mechanical dpdt switches 67 and 68 are used instead of flip-flops. Dptt switches may also be used with the third throw as an off position with no bias to either diode.

TRUTH TABLE FOR FIG. 3

| PORTS: Condition | 55 | 56 | 57 | 58 | IN/OUT Path | OUTPUT PHASE DIFFERENCE |
|---|---|---|---|---|---|---|
| I | N | C | N | C | 60 to 63 | 180° |
| II | C | N | C | N | 60 to 63 | |
| III | C | N | N | C | 60 to 62 | |
| IV | N | C | C | N | 60 to 62 | 180° |
| V | N | N | N | N | 60 to 61 | |

As in the table for FIG. 2 N and C indicate nonconducting and conducting for the diodes terminating the indicated ports. The output phase indications are each relative to each of the other outputs but not relative to the inputs. Condition V is relatively narrow band and would normally be an "open switch" condition with port 61 terminated by its characteristic impedance.

The particular advantage of the FIG. 3 configuration is that its symmetry guarantees the capability of switching the output between port 62 and port 63 with a 0° or 180° phase shift as selected.

In both FIGS. 2 and 3 a certain amount of symmetry is required. In FIG. 2 the connection between junction 30 and junction 31 must equal the electrical length of the connection between junction 30 and junction 32. Likewise the electrical length of the connection between junction 31 and junction 33 must equal the electrical length between junction 32 and junction 33. The same requirements exist for the analogous connections in FIG. 3. To the extent this symmetry does not exist, perfect 180° switching may not occur.

In FIG. 2 the input/output terminals are on asymmetrical arms of a hybrid-T. Due to this asymmetry it is difficult to obtain an absolute fixed phase relation when switching the output between these two arms. The FIG. 3 configuration on the other hand has perfect symmetry between the input/output terminals. This provides the advantage of a fixed phase relationship when switching between terminals as indicated in the table.

While the invention has been described with relation to specific embodiments it is applicable to all circuits or devices using any type of hybrid junction in which two of the branches are terminated with respective switchable impedances exhibiting different reactance and where, upon switching, the different reactances are exactly reversed between the two branches. Although some sources describe a hybrid junction as a waveguide arrangement, there is conflict in the literature on this point and for purposes of the present invention the hybrid junction includes analogous arrangements in coaxial line, strip line and the like. Thus it is the intention to cover the full scope of the invention as set forth in the appended claims. I claim:

1. A hybrid junction phase inverter comprising:

a. a hybrid-T junction having a first pair of branches connected as input/output terminals and a second pair of branches connecting as switching terminals;

b. first and second switchable impedances connected to provide opposite and reversible impedance terminations of said second pair of branches; and c. switching means for reversing the impedance states of said switchable impedances.

2. A hybrid junction phase inverter according to claim 1 wherein said switching means is a flip-flop having first and second complementary outputs, said first complementary output being connected to switch said first switchable impedance and said second complementary output being connected to switch said second switchable impedance.

3. A hybrid junction phase inverter according to claim 1 wherein said switchable impedances are diodes and one is always biased to high conductivity while the other is biased to low conductivity.

4. A hybrid junction phase inverter according to claim 3 wherein said second pair of branches are symmetrical branches of said hybrid-T junction and reversing the impedances shifts the phase of a signal at the output terminal of said first pair of branches by 180°.

5. A hybrid junction switching configuration comprising:

a. first, second, third and fourth hybrid junctions each having first, second, third and fourth branches:

b. means to connect the second and third branches of the first hybrid junction to the first branches of said second and third hybrid junctions respectively;

c. means to connect the fourth branches of said second and third hybrid junctions to the second and third branches respectively of said fourth hybrid junction;

d. first, second, third and fourth impedances connected as terminations of the second and third branches respectively of the second and third hybrid junctions respectively; and e. means to switch said impedances between relatively low and high impedance states asymmetrically with respect to each of said second and third hybrid junctions whereby one of the second and third branches of each of said second and third hybrid junctions is terminated in a high impedance while the other is terminated in a relatively low impedance and switching reverses the impedance conditions for at least one of said second and third hybrid junctions.

6. A hybrid junction switching configuration according to claim 5 wherein said first and fourth hybrid junctions are phase quadrature hybrid junctions and said second and third hybrid junctions are hybrid-T junctions.

7. A hybrid junction switching configuration according to claim 5 wherein said first, second, third and fourth hybrid junctions are all hybrid-T junctions.

8. A hybrid junction switching configuration according to claim 7 wherein said means to switch said impedances comprises first and second flip-flops and a trigger logic circuit for triggering said flip-flops in a logical sequence said first flip-flop having complementary outputs connected to the respective impedances of said second hybrid junction and said second flip-flop having its complementary outputs connected to the respective impedances of said third hybrid junction.

9. A method providing a broad band 180° microwave phase shift comprising:

a. terminating two symmetrical branches of a hybrid-T junction with semiconductor diodes;

b. connecting a signal source to a third branch of said junction;

c. connecting a signal receiver to a fourth branch of said junction; and, d. switching said two semiconductor diodes asymmetrically so that a high conductivity condition in one is always matched by a low conductivity condition in the other and the conductivity conditions are reversed upon switching.

* * * * *